US010349762B2

(12) United States Patent
Steinbock

(10) Patent No.: US 10,349,762 B2
(45) Date of Patent: Jul. 16, 2019

(54) FABRIC COVER

(71) Applicant: Steinbock Design, LLC, Bend, OR (US)

(72) Inventor: Karen M. Steinbock, Bend, OR (US)

(73) Assignee: STEINBOCK DESIGN, LLC, Bend, OR (US)

( * ) Notice: Subject to any disclaimer, the term of this patent is extended or adjusted under 35 U.S.C. 154(b) by 0 days.

(21) Appl. No.: 15/484,130

(22) Filed: Apr. 10, 2017

(65) Prior Publication Data

US 2017/0295964 A1 Oct. 19, 2017

Related U.S. Application Data

(60) Provisional application No. 62/323,094, filed on Apr. 15, 2016.

(51) Int. Cl.

| | |
|---|---|
| ***A47G 9/02*** | (2006.01) |
| ***A47G 9/04*** | (2006.01) |
| ***A47G 9/10*** | (2006.01) |

(52) U.S. Cl.

CPC ..... *A47G 9/0253* (2013.01); *A47G 9/04* (2013.01); *A47G 9/10* (2013.01); *A47G 2009/1018* (2013.01)

(58) Field of Classification Search

CPC ..... A47G 9/00; A47G 9/10; A47G 9/0207; A47G 9/0238; A47G 9/0253; A47G 9/0261

See application file for complete search history.

(56) References Cited

U.S. PATENT DOCUMENTS

| | | | | | |
|---|---|---|---|---|---|
| 834,643 | A * | 10/1906 | Schnadig | A61F 5/485 | 5/484 |
| 1,775,061 | A * | 9/1930 | Gertrude | A47G 9/0253 | 5/490 |
| 2,029,608 | A * | 2/1936 | Buchman | A47G 9/007 | 5/490 |
| 2,118,486 | A * | 5/1938 | Buchman | A47C 27/00 | 5/636 |
| 2,700,165 | A * | 1/1955 | Talisman | F16K 15/202 | 128/DIG. 24 |
| 3,267,496 | A * | 8/1966 | Gionet | A47G 9/0253 | 5/490 |
| 3,734,154 | A * | 5/1973 | Polk | A61M 3/00 | 128/DIG. 24 |

(Continued)

*Primary Examiner* — Peter M. Cuomo
*Assistant Examiner* — Ifeolu A Adeboyejo
(74) *Attorney, Agent, or Firm* — Kali Law Group, P.C.

(57) ABSTRACT

Fabric covers are presented including: a top fabric panel; a bottom fabric panel having substantially equivalent dimensions as the top fabric panel, where the bottom fabric panel and the top fabric define a space for receiving a cushion; a full-width opening disposed along an end of the fabric cover; and a partial opening disposed along an opposite end of the fabric cover. In some embodiments, the partial opening further includes: a first internal flap extending from the opposite end of the fabric cover toward the end and coupled with one of the top fabric panel or the bottom fabric panel substantially perpendicular with the partial opening; and a second internal flap extending from the opposite end of the fabric cover toward the end and coupled with the first internal flap substantially perpendicular with the partial opening.

13 Claims, 3 Drawing Sheets

(56) References Cited

U.S. PATENT DOCUMENTS 4,144,603 A * 3/1979 Schaechter ..... A47G 9/0253 5/490
4,321,710 A * 3/1982 Off ..... A41D 27/20 2/247
4,712,259 A * 12/1987 Chiasson ..... A47G 9/0253 5/490
5,084,928 A * 2/1992 Skillington ..... A47G 9/0253 5/482
5,138,728 A * 8/1992 Aston ..... A47G 9/1045 5/645
5,566,410 A * 10/1996 Schaechter ..... A47G 9/0253 5/490
5,729,846 A * 3/1998 Sullivan ..... A47G 9/062 5/419
5,918,332 A * 7/1999 Dees ..... A47G 9/1045 383/4
5,953,777 A * 9/1999 Buck ..... A47G 9/0253 5/490
6,065,164 A * 5/2000 Swanger ..... A47G 9/0246 5/420
D430,768 S * 9/2000 Hindes ..... D6/601
6,192,536 B1 * 2/2001 Connors ..... A47G 9/062 383/4
6,490,743 B1 * 12/2002 Adat ..... A47G 9/0253 5/490
7,089,617 B1 * 8/2006 Lauro ..... A47G 9/10 5/490
7,111,345 B1 * 9/2006 Hui ..... A47G 9/0207 5/501
7,146,665 B1 * 12/2006 Moorin ..... A47C 7/383 5/644
7,249,389 B2 * 7/2007 Russell ..... A47G 9/0261 5/490
7,810,192 B2 * 10/2010 Fujita ..... A47G 9/10 297/397
7,962,978 B2 * 6/2011 Chuang ..... A47G 9/0207 5/482
7,962,984 B2 * 6/2011 Popp ..... A47D 13/083 5/490
8,028,360 B2 * 10/2011 Regan ..... A47G 9/10 5/490
8,096,009 B2 * 1/2012 Shelby ..... A47C 27/00 5/657.5
8,342,126 B2 * 1/2013 Simon ..... A01K 1/0353 119/28.5
8,615,830 B2 * 12/2013 McQuoid ..... A47G 9/1045 5/636
8,689,375 B2 * 4/2014 Stinchcomb ..... A47G 9/02 5/485
8,931,127 B1 * 1/2015 Moses ..... A47C 27/142 2/65
8,959,683 B2 * 2/2015 Rochlin ..... A47G 9/10 5/490
9,226,605 B1 * 1/2016 Castellano ..... A47G 9/0253
9,307,842 B2 * 4/2016 Gibbons ..... A47C 20/025
9,314,118 B2 * 4/2016 Blazar ..... A47G 9/1027
9,462,902 B1 * 10/2016 Rukel ..... A47G 9/10
9,474,396 B2 * 10/2016 Russell ..... A47G 9/10
9,526,361 B2 * 12/2016 Sellmeyer ..... A47G 9/1045
2005/0229316 A1 * 10/2005 Liao ..... A47G 9/1045 5/639
2006/0112487 A1 * 6/2006 Taylor ..... A47G 9/0253 5/490
2007/0067889 A1 * 3/2007 Spiewak ..... A41D 1/002 2/69
2011/0094003 A1 * 4/2011 Spiewak ..... A41B 1/08 2/69

* cited by examiner

FABRIC COVER

BACKGROUND

Pillowcases are generally well-known in the art for covering or encasing pillows. Pillowcases are commonly described as or include pillow slips, covers, protectors, shams, cushion covers, etc. Conventionally, pillowcases are most often rectangular in shape and closed on three sides. In the most common uses, the opening is positioned along one of the shorter sides of the case, but the opening may also be positioned along the long length of pillowcase, along its middle, or elsewhere.

Pillows may be generally loaded into pillowcases by being pushed into the open side of a pillowcase. This frequently results in bunching, folding, or twisting of the pillow inside the pillowcase. The process of loading pillows into pillowcases is especially challenging with large or overstuffed pillows because the pillowcase tends to fit more snugly. The user often has to smash, bend, stuff, shake, and/or make multiple attempts to get the pillow properly situated within the pillowcase. This can be an inefficient, frustrating, and unpleasant task for workers in hospitality, healthcare, and institutional settings who change many pillowcases each day, as well as for individuals in the common household who may only occasionally change pillowcases.

As such, fabric covers and methods of use are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, in embodiments, fabric covers are presented including: a top fabric panel; a bottom fabric panel having substantially equivalent dimensions as the top fabric panel, where the bottom fabric panel and the top fabric define a space for receiving a cushion; a full-width opening disposed along an end of the fabric cover; and a partial opening disposed along an opposite end of the fabric cover. In some embodiments, the partial opening is centered along the opposite end of the fabric cover. In some embodiments, the partial opening further includes: a first internal flap extending from the opposite end of the fabric cover toward the end and coupled with one of the top fabric panel or the bottom fabric panel substantially perpendicular with the partial opening; and a second internal flap extending from the opposite end of the fabric cover toward the end and coupled with the first internal flap substantially perpendicular with the partial opening, where the first internal flap and the second internal flap define a sleeve substantially perpendicular with the partial opening. In some embodiments, ends of the first internal flap and the second internal flap are coupled with one or more side seams of the top fabric panel and the bottom fabric panel. In some embodiments, the top fabric panel and the bottom fabric panel include a single fabric panel. In some embodiments, the top fabric panel and the bottom fabric panel include at least two fabric panels. In some embodiments, fabric covers further include at least two side panels. In some embodiments, the partial opening further includes a closure element such as: a hook and loop closure element, a button closure element, a zipper closure element, a hook and eye closure element, a clip closure element, a snap closure element, an envelope element, an internal pouch element, and a tuck-in design element.

In other embodiments, methods of using a fabric cover are presented including: providing a cushion; providing the fabric cover, the fabric cover including, a top fabric panel, a bottom fabric panel having substantially equivalent dimensions as the top fabric panel, where the bottom fabric panel and the top fabric define a space for receiving a cushion; a full-width opening disposed along an end of the fabric cover, and a partial opening disposed along an opposite end of the fabric cover; reaching through the partial opening to grasp the cushion through the full-width opening; and guiding the cushion through the full-width opening to enclose the cushion. In some embodiments, the partial opening further includes: a first internal flap extending from the opposite end of the fabric cover toward the end and coupled with one of the top fabric panel or the bottom fabric panel substantially perpendicular with the partial opening; and a second internal flap extending from the opposite end of the fabric cover toward the end and coupled with the first internal flap substantially perpendicular with the partial opening, wherein the first internal flap and the second internal flap define a sleeve substantially perpendicular with the partial opening. In some embodiments, methods further include: adjusting either the first internal flap or the second internal flap to close the partial opening whereby the cushion is not exposed along the partial opening.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In general, embodiments provide a fabric cover having a full-width opening disposed along one end of the fabric cover and a partial opening along an opposite end of the fabric cover through which a user may insert their hand to grasp a cushion or pillow in order to pull the pillow or cushion into the fabric cover through the full-width opening. As utilized herein, cushion may be understood to be substantially equivalent to any of: a pillow, a pad, a foam core, or a mat of any size or shape.

Figure 1:
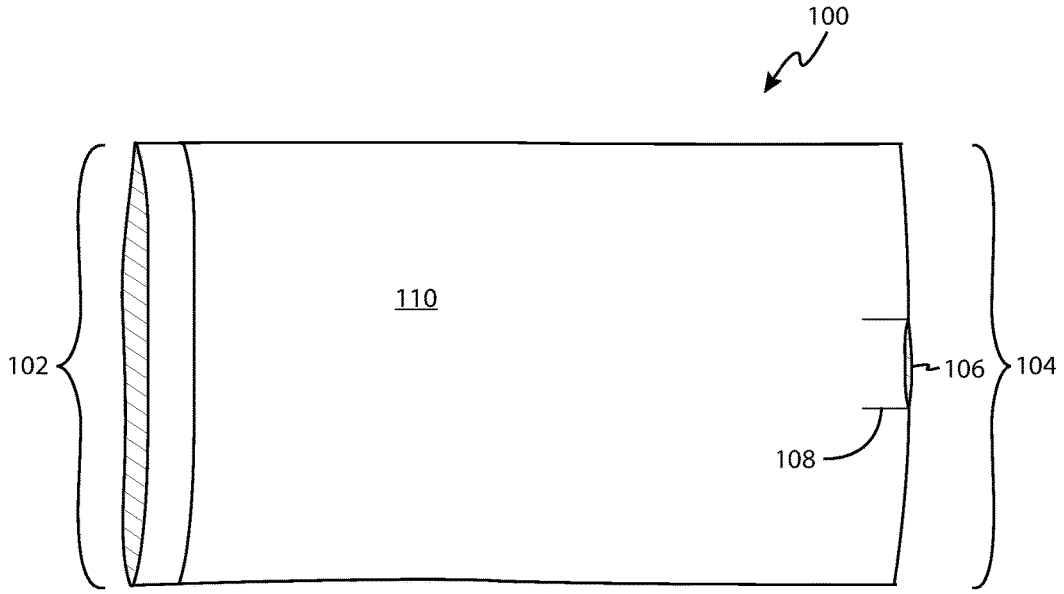
FIG. 1 is an illustrative representation of a top view of a fabric cover in accordance with embodiments of the present invention.

FIG. 1 is an illustrative representation of a top view of fabric cover 100 in accordance with embodiments of the present invention. In particular, as illustrated, fabric cover 100 includes top fabric panel 110. Fabric cover 100 further includes a full-width opening along end 102 of the fabric cover as well as partial opening 106 along opposite end 104 of the fabric cover. In embodiments, the partial opening may be in a range of 4 to 12 inches across. Further illustrated is an internal flap 108 extending from opposite end 104 of the fabric cover toward end 102 and coupled with either the top or bottom fabric panel substantially perpendicular with the partial opening thus defining a sleeve. In some embodiments, stitch lines may be visible on the top or bottom fabric panel. It may be further noted that partial opening 106 may be centered along opposite end 104 of fabric cover 100 as illustrated, or may be positioned along any portion of opposite end 104 without limitation.

Figure 2:
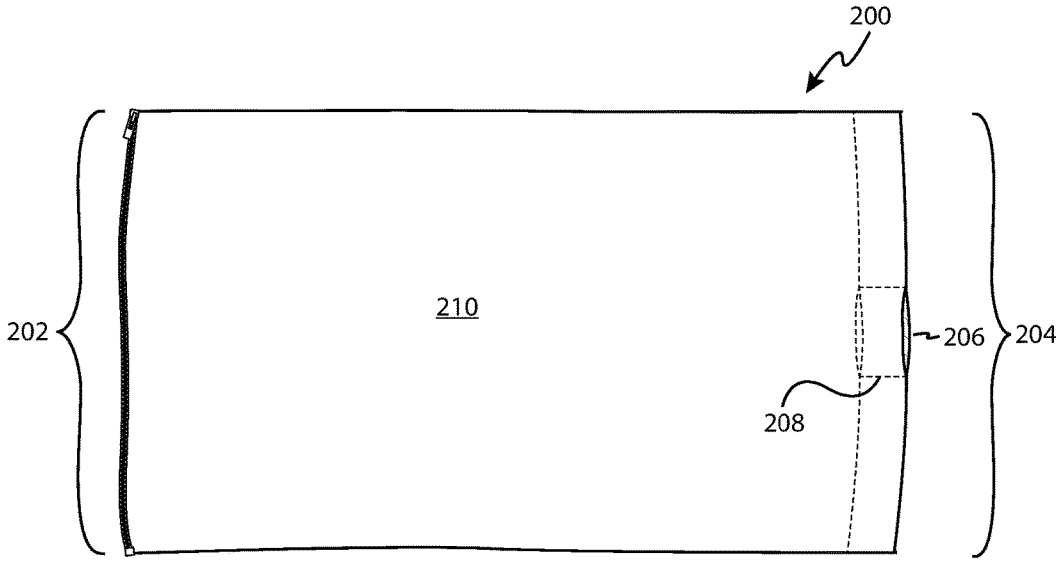
FIG. 2 is an illustrative representation of a bottom view of a fabric cover in accordance with embodiments of the present invention.

FIG. 2 is an illustrative representation of a bottom view of fabric cover 200 in accordance with embodiments of the present invention. In particular, as illustrated, fabric cover 200 includes bottom fabric panel 210. Fabric cover 200 further includes a full-width opening along end 202 of the fabric cover as well as partial opening 206 along opposite end 204 of the fabric cover. In this illustrated embodiments, a zipper may be utilized to close fabric covers. Other closure elements may be utilized such as, a hook and loop closure element, a button closure element, a hook and eye closure element, a clip closure element, a snap closure element and fabric closure designs such as an envelope an internal pouch, as well as a tuck-in design without limitation and without departing from embodiments provided herein. Further illustrated is internal flap 208 extending from opposite end 204 of the fabric cover toward end 202. Importantly, internal flap 208 is coupled with either the top or bottom fabric panel along the partial opening along with internal flap 108 disclosed above for FIG. 1. By having both internal flaps coupled with either the top or bottom fabric panel, an inserted pillow or cushion may be covered by the flap such that the partial opening does not expose the inserted pillow or cushion. In addition, the internal flaps define a sleeve through which a user may insert their hand or arm. As illustrated, the defined sleeve may be substantially perpendicular with the partial opening. In some embodiments, a sleeve may have a length in a range of approximately 0.5 to 4.0 inches. In still other embodiments, the sleeve may be extended outwardly from the fabric cover such that the sleeve may be "tucked in" after fabric cover is placed on cushion. In this manner, the cushion may be protected from being exposed. As above, it may be further noted that partial opening 206 may be centered along opposite end 204 of fabric cover 200 as illustrated, or may be positioned along any portion of opposite end 204 without limitation. In some embodiments, either or both ends of internal flaps may be coupled with top and bottom fabric panel side seams.

It may be further appreciated that, the top fabric panel and the bottom fabric panel may comprise one or more fabric panels without limitation. Still further, top and bottom fabric panels may form any number of shapes such as a rectangle, a square, a circle, a semi-circle, and oval, and a parallelogram without departing from embodiments herein. Although not illustrated, these shapes may be readily discerned by one skilled in the art and the illustrative representations are provided for clarity in understanding elements of the invention without being so limited. In some embodiments, fabric covers may be manufactured from a fabric such as, a waterproof fabric, an antimicrobial fabric, an anti-allergenic fabric, a disposable fabric, a non-slip material fabric, or any combination thereof. In some embodiments, a liner may be utilized with fabric cover embodiments without limitation. It may be further appreciated that, like the zipper utilized for full-width opening embodiments, partial opening embodiments may include a closure element such as, for example, a hook and loop closure element, a button closure element, a zipper closure element, a hook and eye closure element, a clip closure element, a snap closure element, and fabric closure designs such as an envelope an internal pouch, and a tuck-in design.

Figure 3:
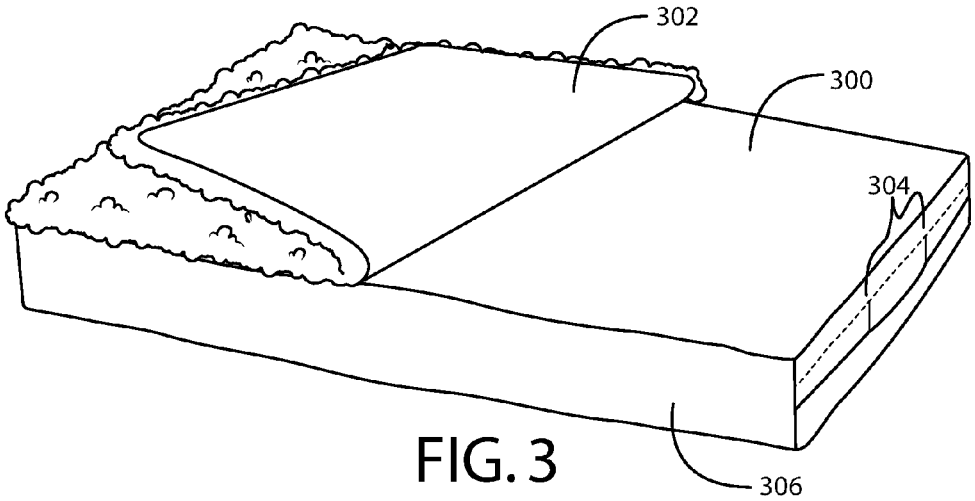
FIG. 3 is an illustrative representation of an orthogonal view of a fabric cover with topper in accordance with embodiments of the present invention.

FIG. 3 is an illustrative representation of an orthogonal view of fabric cover 300 with topper 302 in accordance with embodiments of the present invention. Fabric cover embodiments may be utilized in a variety of combinations. As illustrated, topper 302 may be coupled with fabric cover 300. As illustrated, fabric cover 300 includes side panel 306 in any manner known in the art. Side panels may be of various widths in embodiments. Further illustrated, partial opening 304 may be positioned along a side panel. Toppers are well-known in the art and may be useful for a providing a pet pad that may be easily disassembled and washed. Pet pads are often manufactured from a relatively stiff or inflexible foam making insertion into a cover difficult. Utilizing embodiments provided herein, a user may easily insert an otherwise difficult to manage foam cushion into fabric cover embodiments. In some embodiments toppers may be removably coupled with fabric covers. In some embodiments toppers may include an additional pad, a heading pad, a cooling pad, etc.

Figure 4:
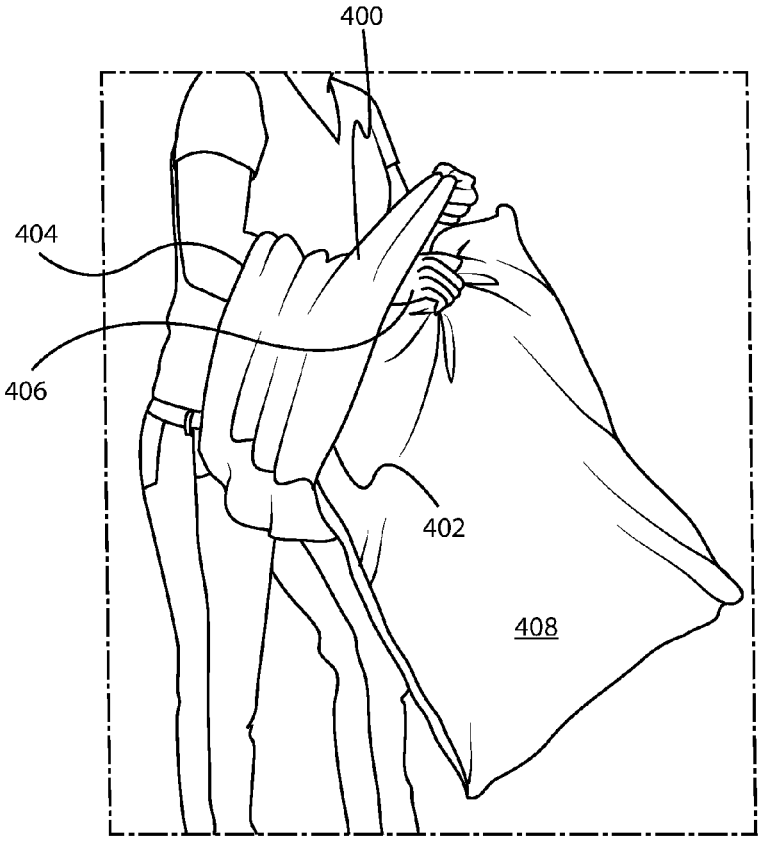
FIG. 4 is an illustrative representation of methods for using a fabric cover in accordance with embodiments of the present invention.

FIG. 4 is an illustrative representation of methods for using fabric cover 400 in accordance with embodiments of the present invention. As illustrated, fabric cover 400 and pillow or cushion 408 may be provided. A user may insert their hand 406 through partial opening 404 and may grasp pillow 408 through full-width opening 402.

Figure 5:
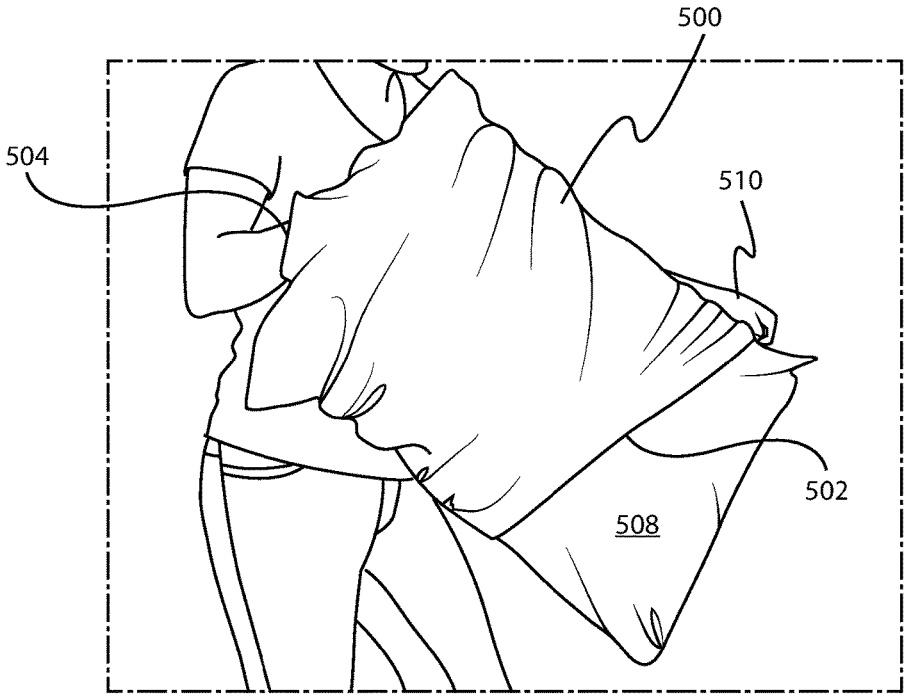
FIG. 5 is an illustrative representation of methods for using a fabric cover in accordance with embodiments of the present invention.

FIG. 5 is an illustrative representation of methods for using fabric cover 500 in accordance with embodiments of the present invention. As illustrated, pillow 508 may be drawn through full-width opening 502. This may be accomplished by a user continuing to grasp pillow 508 through partial opening 504 while utilizing opposite hand 510 to guide fabric cover 500 over pillow 508.

Figure 6:
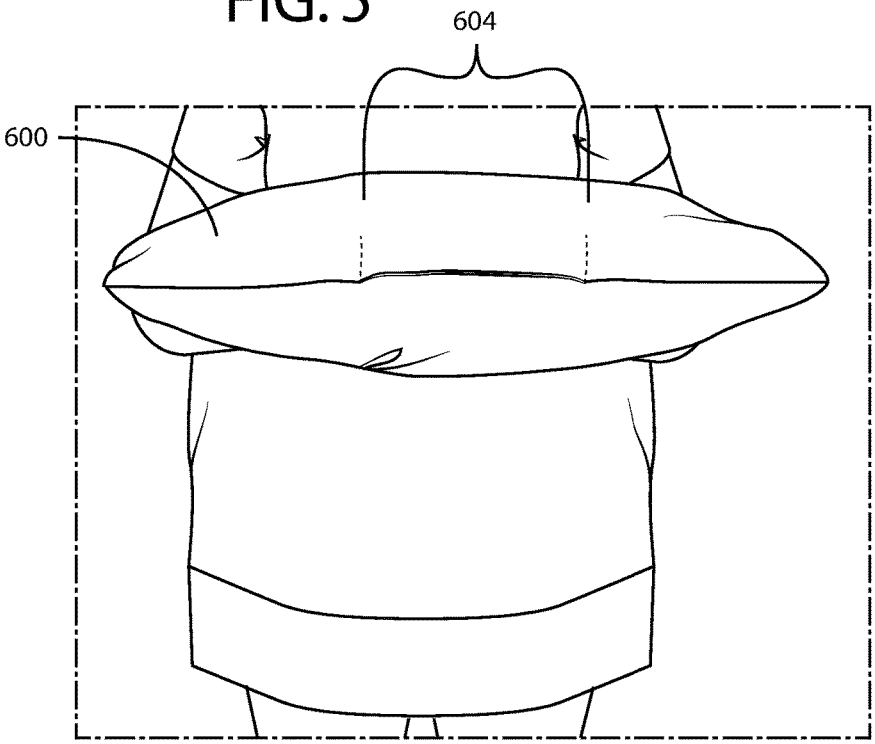
FIG. 6 is an illustrative representation of methods for using a fabric cover in accordance with embodiments of the present invention.

FIG. 6 is an illustrative representation of methods for using fabric cover 600 in accordance with embodiments of the present invention. As illustrated, a pillow is completely enclosed in fabric cover 600. Because of internal flap embodiments, partial opening 604 is closed thus preventing the pillow from being exposed.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A fabric cover comprising:

a top fabric panel;

a bottom fabric panel having substantially equivalent dimensions as the top fabric panel, wherein the bottom fabric panel and the top fabric define a space for receiving a cushion;

a full-width opening disposed along an end of the fabric cover; and a partial opening disposed along an opposite end of the fabric cover;

a first internal flap extending from the opposite end of the fabric cover toward the end of the fabric cover; and a second internal flap extending from the opposite end of the fabric cover toward the end of the fabric cover, wherein the first internal flap and the second internal flap define a sleeve substantially perpendicular with the partial opening along a sleeve length and extending toward the end of the fabric cover, wherein the sleeve opens on a first end at the partial opening and opens on a second end within the space, wherein the sleeve is coupled along the partial opening of the fabric cover, wherein the first internal flap is coupled with the bottom fabric panel beyond the second end opening and along the sleeve length extending toward the end of the fabric cover, and wherein the second internal flap covers the partial opening when a pillow is inserted into the fabric cover.

2. The fabric cover of claim 1, wherein the partial opening is centered along the opposite end of the fabric cover.

3. The fabric cover of claim 1, wherein ends of the first internal flap and the second internal flap are coupled with one or more side seams of the top fabric panel and the bottom fabric panel.

4. The fabric cover of claim 1, wherein the top fabric panel and the bottom fabric panel comprise a single fabric panel.

5. The fabric cover of claim 1, wherein the top fabric panel and the bottom fabric panel comprise at least two fabric panels.

6. The fabric cover of claim 1, further comprising at least two side panels.

7. The fabric cover of claim 1, wherein the top fabric panel and the bottom fabric panel form a shape selected from the group consisting of: a rectangle, a square, a circle, a semi-circle, and oval, and a parallelogram.

8. The fabric cover of claim 1, wherein the partial opening further comprises a closure element.

9. The fabric cover of claim 8, wherein the closure element is selected from the group consisting of: a hook and loop closure element, a button closure element, a zipper closure element, a hook and eye closure element, a clip closure element, a snap closure element, an envelope element, an internal pouch element, and a tuck-in design element.

10. A method of using a fabric cover comprising:

providing a cushion;

providing the fabric cover, the fabric cover including, a top fabric panel, a bottom fabric panel having substantially equivalent dimensions as the top fabric panel, wherein the bottom fabric panel and the top fabric define a space for receiving a cushion, a full-width opening disposed along an end of the fabric cover, and a partial opening disposed along an opposite end of the fabric cover;

a first internal flap extending from the opposite end of the fabric cover toward the end of the fabric cover; and a second internal flap extending from the opposite end of the fabric cover toward the end of the fabric cover, wherein the first internal flap and the second internal flap define a sleeve substantially perpendicular with the partial opening along a sleeve length and extending toward the end of the fabric cover, wherein the sleeve opens on a first end at the partial opening and opens on a second end within the space, wherein the sleeve is coupled along the partial opening of the fabric cover, and wherein the sleeve the first internal flap is coupled with the bottom fabric panel beyond the second end opening and along the sleeve length extending toward the end of the fabric cover;

reaching through the partial opening to grasp the cushion through the full-width opening; and guiding the cushion through the full-width opening to enclose the cushion, wherein the second internal flap is configured to cover the partial opening when the cushion is inserted into the fabric cover.

11. The method of claim 10, further comprising:

adjusting the second internal flap to close the partial opening whereby the cushion is not exposed along the partial opening.

12. The fabric cover of claim 1, wherein the sleeve length is approximately 0.75-4 inches.

13. The method of claim 10, wherein the sleeve length is approximately 0.75-4 inches.

* * * * *